US005077950A

United States Patent [19]

Bretches et al.

[11] Patent Number: 5,077,950

[45] Date of Patent: Jan. 7, 1992

[54] SIMULATED WINDOW PANE MOLDING

[76] Inventors: Donald D. Bretches; Joanellen K. Hart-Bretches, both of 23 Balmoral Park, Pinewood Gardens 02-04, Singapore, Singapore, 1025

[21] Appl. No.: 704,111

[22] Filed: May 22, 1991

[51] Int. Cl.[5] ..... E06B 3/68

[52] U.S. Cl. ..... 52/456; 52/314; 52/DIG. 4; 52/312; 52/313

[58] Field of Search ..... 52/717, DIG. 4, 455, 52/456, 311, 313, 314, 202, 203, 312; 49/501

[56] References Cited

U.S. PATENT DOCUMENTS

| | | | |
|---|---|---|---|
| 3,058,517 | 10/1962 | Jacobs et al. . | |
| 3,111,728 | 11/1963 | Alderfer | 52/DIG. 4 X |
| 3,340,661 | 9/1967 | Krieger | 52/311 X |
| 3,358,412 | 12/1967 | Martin . | |
| 3,372,522 | 3/1968 | Engstrom . | |
| 3,456,374 | 6/1969 | Baermann | 52/DIG. 4 X |
| 3,950,894 | 4/1976 | DiMaio | 52/DIG. 4 X |
| 4,387,541 | 6/1983 | Boomershine | 52/DIG. 4 X |
| 4,437,284 | 3/1984 | Cribben et al. | 52/311 X |
| 4,510,986 | 4/1985 | Schwankl | 52/202 X |
| 4,598,520 | 7/1986 | Ellstrom | 52/456 |

*Primary Examiner*—2
*Assistant Examiner*—Robert Canfield
*Attorney, Agent, or Firm*—Norman B. Rainer

[57] ABSTRACT

A simulated windowpane molding is achieved by inner and outer elongated members adapted to be placed in facing relationship upon opposite sides of a windowglass. Each elongated member has a flat surface adapted to fit flush against the windowglass. Magnetic holding structure in the form of a strip of plastic material containing a ferromagnetic powder, or a series of permanent magnets in bar form is disposed upon the flat surface of at least one elongated member. The flat surface of the other elongated member is either equipped with the same magnetic holding structure or material, such as iron, which is attracted by a magnet. When the two elongated members are brought into facing, mirror-image juxtaposition upon an intervening windowglass, the force of attraction between the two members is sufficient to cause the members to be securely positioned upon the windowglass.

7 Claims, 2 Drawing Sheets

SIMULATED WINDOW PANE MOLDING

BACKGROUND OF THE INVENTION

1. Field of the Invention

This invention relates to windows of buildings, and more particularly concerns apparatus for adjustably modifying the appearance of the window.

2. Description of the Prior Art

The appearance of windows, especially those of residential buildings is often an important factor in the overall outer appearance of a building, and may significantly enhance the decor of rooms. The number, shape and position of "panes" of glass in a window or window assembly influence its appearance. Each pane of glass is generally perceived as being separately bordered by framing, usually of wood molding construction. Although each pane may in fact be a separate piece of glass joined to adjacent panes by virtue of said framing, it has been known to simulate separate panes by attaching framing pieces to a single large integral pane of glass. One reason for such simulation is that it is generally less expensive to have a window constructed of a single pane rather than a multitude of panes. There is also some desirability in being able to vary the appearance of an existing window.

It is been earlier known that a variable window appearance can be produced with adjustably positionable molding strips that are secured against the interior surface of the window, said securement being achieved by virtue of holes or other holding means in the outer frame or casement of the window. Such installations, however, do not present the realistic appearance of separate panes held in place by wooden molding. Also, such earlier installations were lacking in versatility because of the fixed sites of securement.

It is accordingly an object of the present invention to provide a simulated window molding producing a realistic multi-pane appearance on a window.

It is another object of this invention to provide a simulated molding of the foregoing object which can be applied to both surfaces of a window.

It is a further object of the present invention to provide a simulated molding of the aforesaid nature, capable of varied adjustability upon a window and easy removal to facilitate cleaning of the window.

It is yet another object of this invention to produce a simulated molding of the aforesaid nature of simple, durable construction and amenable to low cost manufacture and easy installation.

These objects and other objects and advantages of the invention will be apparent from the following description.

SUMMARY OF THE INVENTION

The above and other beneficial objects and advantages are accomplished in accordance with the present invention by a simulated window pane molding comprising: an elongated inner member having a flat surface adapted to contact the interior surface of a windowglass, and an elongated outer member having a flat surface adapted to contact the exterior surface of the same windowglass, both inner and outer elongated members being of uniform cross-sectional contour and having centered within said flat surface means for exerting magnetic force. Suitable means for exerting magnetic force include: a linear and coplanar array of permanent magnets, a continuous strip of plastic material filled with a powder having permanent magnetic properties, and a material which is attracted to a magnet, with the proviso that at least one of the inner and outer elongated members contains either an array of permanent magnets or a strip of plastic having permanent magnetic properties.

The inner and outer elongated members are of substantially identical external appearance. The means for exerting magnetic force are preferably recessed and centered within said flat surfaces in coextensive alignment with the axis of elongation of the elongated member. The elongated members are preferably fabricated of a thermoplastic resin as extrudates produced by way of an extrusion process, and finished to have a wood-like appearance. Alternatively, the elongated member may be fabricated of wood.

In use, a pair of said elongated members are disposed in mirror-image relation upon opposite surfaces of the windowglass such that the means for exerting magnetic force are in facing relationship. By virtue of such manner of construction and use, there is produced the effect of separate panes of glass held together by the simulated molding.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
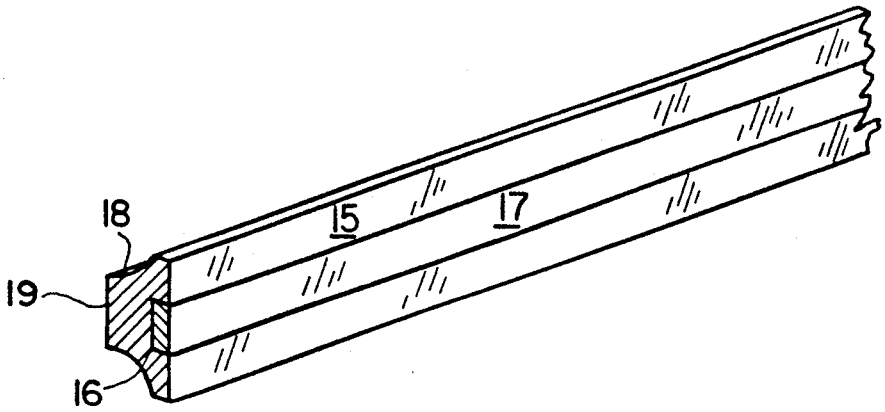
FIG. 1 is a rear perspective view of an embodiment of an elongated member of the simulated molding of the present invention.
Figure 2:
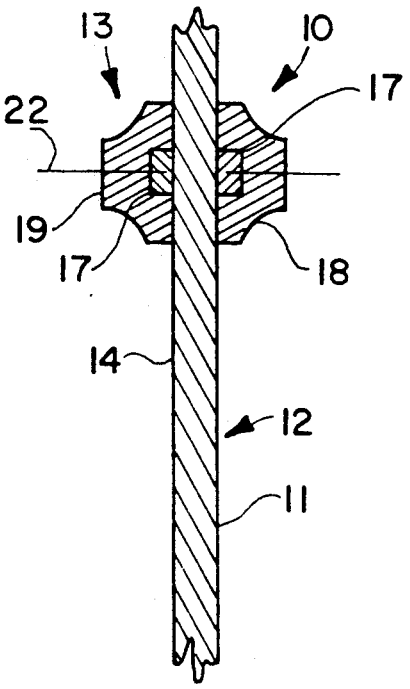
FIG. 2 is a sectional transverse view of the embodiment of FIG. 1 shown emplaced upon a windowglass.
Figure 3:
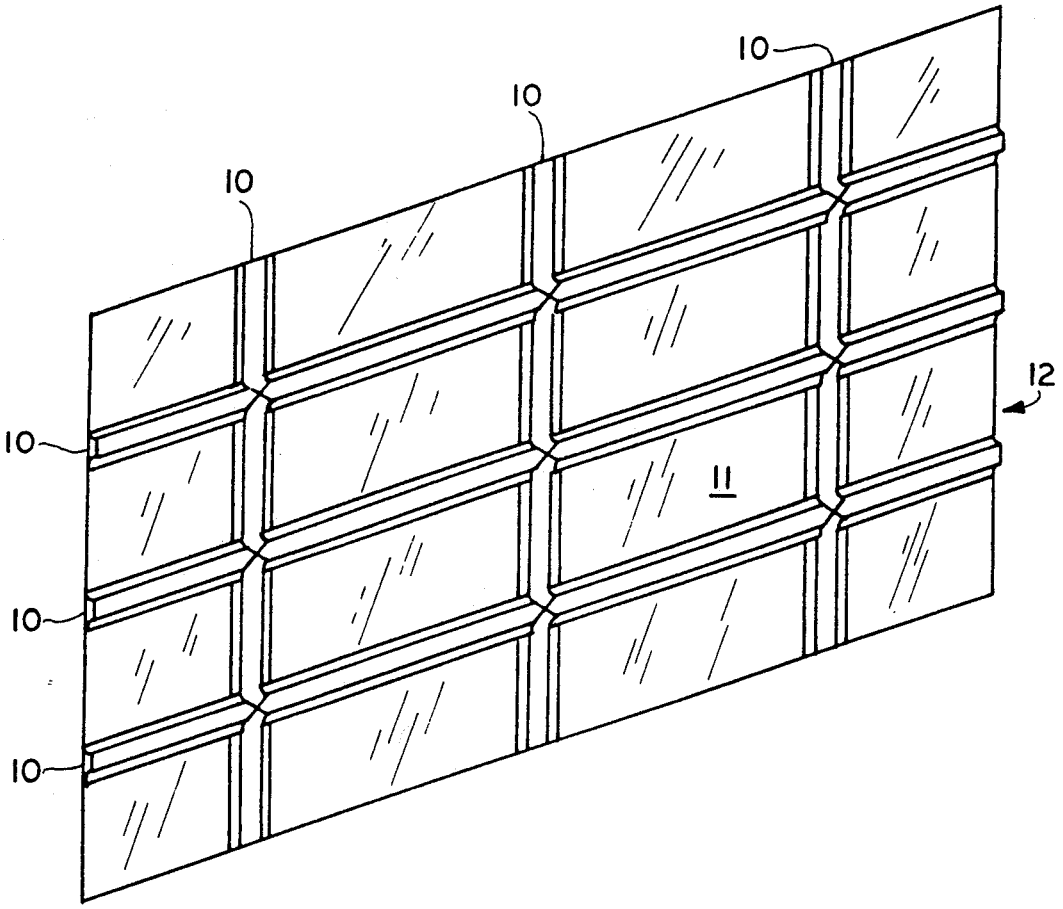
FIG. 3 is a perspective view of a window equipped with simulated molding of this invention to present an appearance of multiple rectangular panes.

Referring to FIGS. 1–4, an embodiment of the simulated molding of the present invention is shown comprised of elongated inner member 10 adapted to contact the interior surface 11 of windowglass 12, and elongated outer member 13 adapted to contact the exterior surface 14 of said windowglass.

Both elongated members 10 and 13 have the same appearance, being of uniform cross-sectional contour fabricated as by the extrusion of a thermoplastic resin. Each elongated member has a flat surface 15 adapted to fit against a surface of the windowglass. Each flat surface is provided with a recess 16 centered upon the axis of elongation of the elongated member. A strip 17 of plastic which contains permanent magnetic material is held within recess 16.

Strip 17 is preferably comprised of a resilient plastic such as plasticized polyvinylchloride having uniformly dispersed therein a powdered ferromagnetic material. In at least one of said strips, the ferromagnetic material exerts a permanent magnetic force. Suitable powdered materials for providing permanent magnetic force include red iron oxide (gamma-$Fe_2O_3$) and certain oxides of cobalt and chromium. One of said strips may instead have characteristics of magnetic susceptibility. Suitable powdered materials for providing magnetic susceptibility include iron and magnetic ferrite as used in certain photographic copying processes. The strips 17 are held within recess 16 either by friction fit or by a bonding agent.

Alternative to the exemplified use of strip 17, the means for exerting magnetic force may instead be a number of individual permanent magnets disposed in a linear and coplanar array within recess 16. The individual magnets are preferably of identical bar configuration, having separated north and south poles. In such instance, the polarities of the individual magnets are maintained in alignment, whether said polarities are separated along the axis or transverse thereto. By virtue of such alignment of polarities, when the flat surfaces 15 of the elongated members are placed in mirror-image opposition about a windowglass, the opposite, attracting poles are in facing juxtaposition. Combinations of strips of plastic magnetic material and individual permanent magnets may also be employed as the means for exerting magnetic force.

The side and rear surfaces 18 and 19, respectively, are configured such as to resemble conventional wooden molding. It is to be noted however, that the elongated members have a plane of symmetry that orthogonally bisects flat surface 15 in the direction of elongation of said elongated members.

Figure 4:
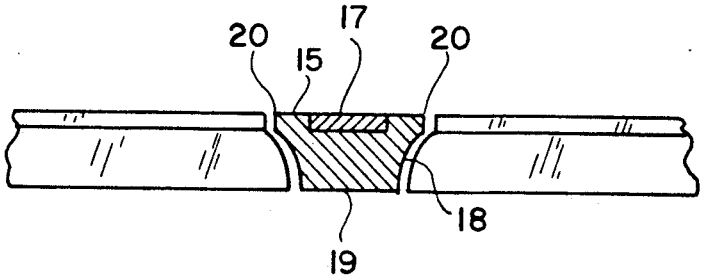
FIG. 4 shows several pieces of the simulated molding in abutment.

When applied in intersecting patterns upon a windowglass, the end extremities 20 may be contoured, as shown in FIG. 4, to fit flush against an cooperating, transversely oriented member.

Although the simulated molding of this invention has been exemplified primarily as having been fabricated of extruded plastic, it is to be understood that other materials, such as wood, may be employed in place of the plastic.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A simulated window pane molding comprising: an elongated inner member having a flat surface adapted to contact the interior surface of a windowglass, and an elongated outer member having a flat surface adapted to contact the exterior surface of the same windowglass, both inner and outer elongated members being of uniform cross-sectional contour and having centered within said flat surface means for exerting magnetic force and selected from the group consisting of a linear and coplanar array of permanent magnets, a continuous strip of plastic material containing a powder having permanent magnetic properties, and a material which is attracted to a magnet, with the proviso that at least one of the inner and outer elongated members contains either an array of permanent magnets or a strip of plastic material containing a powder having magnetic properties.

2. The molding of claim 1 wherein both said inner and outer elongated members are comprised of a thermoplastic resin.

3. The molding of claim 2 wherein said inner and outer members are extrudates.

4. The molding of claim 1 wherein both said inner and outer member are identical.

5. The molding of claim 4 having a wood-like appearance.

6. The molding of claim 1 wherein said means for exerting magnetic force are recessed within said flat surfaces in coextensive alignment with the axis of elongation of the elongated member.

7. The molding of claim 1 wherein said permanent magnets are of bar shape, having north and south poles which are uniformly aligned.

* * * * *